US005909847A

United States Patent [19]

Munsche et al.

[11] Patent Number: 5,909,847

[45] Date of Patent: Jun. 8, 1999

[54] FLUSHING CLEANER FOR MULTIPLE SHOWER WAND ASSEMBLIES

[75] Inventors: Denis Munsche, Neenah; Daniel Schwalenberg, Little Chute, both of Wis.

[73] Assignee: Productive Solutions Inc., Neenah, Wis.

[21] Appl. No.: 09/032,489

[22] Filed: Feb. 27, 1998

Related U.S. Application Data

[60] Provisional application No. 60/039,769, Mar. 3, 1997.

[51] Int. Cl.[6] ..... B05B 15/02

[52] U.S. Cl. ..... 239/116

[58] Field of Search ..... 239/112–116, 106, 239/556, 557, 583

[56] References Cited

U.S. PATENT DOCUMENTS

| | | | |
|---|---|---|---|
| 1,019,013 | 3/1912 | Baker et al. | 239/116 |
| 2,177,429 | 10/1939 | Foster | 239/116 |
| 2,283,768 | 5/1942 | Schueler | 239/116 |
| 2,784,032 | 3/1957 | Johansson | 299/59 |
| 4,867,870 | 9/1989 | Kettlety et al. | 239/116 |
| 5,664,731 | 9/1997 | Lemetyinen et al. | 239/116 |

FOREIGN PATENT DOCUMENTS

| | | | |
|---|---|---|---|
| 447226 | 3/1948 | Canada | 239/115 |

*Primary Examiner*—Joseph A. Kaufman
*Assistant Examiner*—Dinh Q Nguyen
*Attorney, Agent, or Firm*—Russell L. Johnson, Patent Agent

[57] ABSTRACT

A manifolded multiple wand spray apparatus with internal cleaning brushes and a flush valve that is activated when the rods carrying the cleaning brushes are rotated is disclosed. Valves that redirect the flow of water away from the manifold for a brief period during which spray orifice cleaning can be accomplished and an air intake valve that will admit air into the manifold to speed the flushing and create a negative pressure in the spray wands so as to draw obstructing materials into the spray wand during flushing is also disclosed.

5 Claims, 4 Drawing Sheets

FLUSHING CLEANER FOR MULTIPLE SHOWER WAND ASSEMBLIES

CROSS REFERENCES TO RELATED APPLICATIONS

This application claims the benefits of Provisional Patent application 60/039,769 filed Mar. 3, 1997.

BACKGROUND OF THE INVENTION

In systems that use large quantities of water there are often problems associated with water usage, and waste water discharge. Recirculating or closed systems have become more common in industries such as paper making and some refining processes. The apparatus of this invention was developed for use in the paper making industry, but the apparatus has found uses for other applications such as waste water treatment.

In paper making it has become beneficial to recirculate process water and/or reclaim as much of the paper making fibers that find their way into the waste water as is possible. In one process, the waste water is passed through rotating filter discs that collect a mat of fibers and then pass the filter carrying the fiber mat past a knock off shower which separates the mat from the filter and then passes the filter between the wands of a cleaning shower where clays, aggregates and precipitates which are clinging to the filter are washed therefrom, and then returns the filter to the waste water stream to collect another fiber mat.

FIELD OF THE INVENTION

Arrangements wherein spray nozzles are cleaned by brushes are old in the art.

This invention adds to the spray nozzle, chamber, and brush combination, a valve arrangement that is connected to the brush moving assembly so that as the brushes are moved past the nozzles, a valve is opened at the bottom of the chamber and the water in the chamber with the dislodged particles suspended therein is flushed out of the bottom of the pressure chamber. Reversing the procedure closes the chamber and removes the brushes from in front of the spray nozzle and returns the spray system to readiness for use.

Heretofore flushing cleaners for spray nozzles and/or spray showers have been troubled by precipitous drops in pressure when a flushing valve is opened to flush dislodged particles from a spray nuzzle chamber. For this and other reasons flushing cleaners have been restricted to a single chamber unit. In most applications, the need to conduct the discharged flushing stream away from the spray assembly placed limitations on the use of such flushing cleaners in multiple wand or shower applications.

Heretofore, the art has not provided a flushing cleaner for multiple wand spray showers. To those unskilled in the art, the problems associated with pressure changes in a manifolded system are not obvious. It is therefore not obvious why simply multiplying a system for flushing a single shower or spray wand assembly can not be employed with equal success to a multiple shower wand assembly and manifold system.

The systems for which this multiple shower wand flushing cleaner was developed are continuous flow closed systems used to remove waste materials from the discharge waters of paper making machines. Removing the showers from service for any significant period of time would result in a backup of waste materials in the system and the shutting down of the paper machine which is very expensive. It is therefore desirable to remove the accumulated materials from around all of the nozzles on all of the wands of the system at the same time and in the shortest interval possible.

If one simply opened valves at the end of each wand on a manifold and allowed water to flow freely through the wands, the pressure drop across the manifold would be such that the most distal wand from the pressure source would receive considerably less water at a considerably reduced pressure, (if it received any at all), than would the most proximal wand.

It is a novel design feature of this invention that the orifices of the discharge valves of each wand are sized so that the sum of the cross sectional areas of all the orifices is such that adequate pressure and water flow to the most distal wand from the pressure source is maintained so that the most distal wand is flushed in the interval in which all the discharge valves are opened. A typical cleaning and flushing cycle would have an interval in the order of from 3 to 5 seconds.

Over time, particles become lodged in the spray orifice in such a way that they can not be dislodged by the brushes. It is common Practice to clear such materials during periodic scheduled machine shut downs. It has been found that if the flow of water to the shower is shut down and the discharge valves of the wands are opened, a negative pressure will develop within each wand and air will be drawn into open spray orifices. Particles lodged in the spray orifices will thereby be caused to enter the turbulent discharger flow of water in the wand chamber. This cleaning assist facilitates removing particles from the spray orifices, and reduces the chances of their reentering the orifices, thereby increasing the speed and efficiency of the orifice cleaning process. This, second mode, of orifice cleaning has heretofore been unknown in the spry wand art.

It is therefore an object of this invention to provide an orifice cleaning and flushing means for use in a manifolded multiple shower wand spray system.

It is further an object of this invention to provide the above described cleaning and flushing means wherein each wand is provided with a discharge valve having a discharge opening which is sized to permit the opening of all the discharge valves on all the shower wands attached to the manifold at once without reducing the pressure in the most distal wand to the point where adequate flushing pressure is lost.

It is further an object of this invention to provide the cleaning and flushing means described above wherein a negative pressure cleaning assist is obtainable.

Other objects will become apparent from the following specifications and drawings.

DESCRIPTION OF THE RELATED ART

The prior art teaches spray and shower apparatus that include in their structures some of the elements of the spray nozzle assembly of this invention.

Canadian patent number 447,226 to Larson et al. teaches a central rod in a spray tube wherein wipers attached to the central rod sweep across spray openings in the spray tube and the central rod is connected to a rotary flush valve that is opened and closed by the rotation of the the central rod.

U.S. Pat. No. 2,784,032 to Johansson teaches a spray pipe having a central rod with spray opening clearing elements attached thereto and a system of valves that are opened and closed to back-flush the pipe as the openings are scraped clean.

The self cleaning spray rod art contains most of the elements of this invention performing most of the functions that are performed by this invention. What the self cleaning spray or shower rod art does not contain is a multiple spray wand manifold of showers that is self cleaning. The art also does not contain a self cleaning spray wand that develops an air flow into the spray nozzles as the wand is flushing so as to draw obstructions inward where they can be removed from the chamber by flushing. This invention further discloses the sizing and proportions for manifold, spray wand and discharges that will enable the self cleaning multiple shower wand assemblies to clean all of the manifolded shower wands in one parallel cycle.

SUMMARY OF INVENTION

A flushing spray nozzle cleaning apparatus for manifolded spray wand assemblies comprising;

a) an elongate manifold chamber having a liquid introduction port and a multiplicity of shower wands extending laterally therefrom, b) each wand having a manifold end and a valve end and at least one spray orifice directed laterally to said wand, c) a rotating valve at said valve end of each wand and the rotating valve is provided with a discharge port that has an area that is no larger than 1/N times the cross sectional area of one of the wands where N equals the number of wands extending from said manifold, d) a central brush rod secured to said valve and at least one brush secured to said rod and said brush is positioned so that said brush will pass over said spray orifice and said valve will be opened or closed when said rod is rotated, e) a means for rotating all the brush rods in all the shower wands in unison.

The flushing spray nozzle apparatus as described above when provided with a means for shutting off the flow of water to the manifold chamber will develop a negative pressure cleaning assist that will be disclosed in detail hereinafter.

DESCRIPTION OF THE PREFERRED EMBODIMENTS

Figure 1:
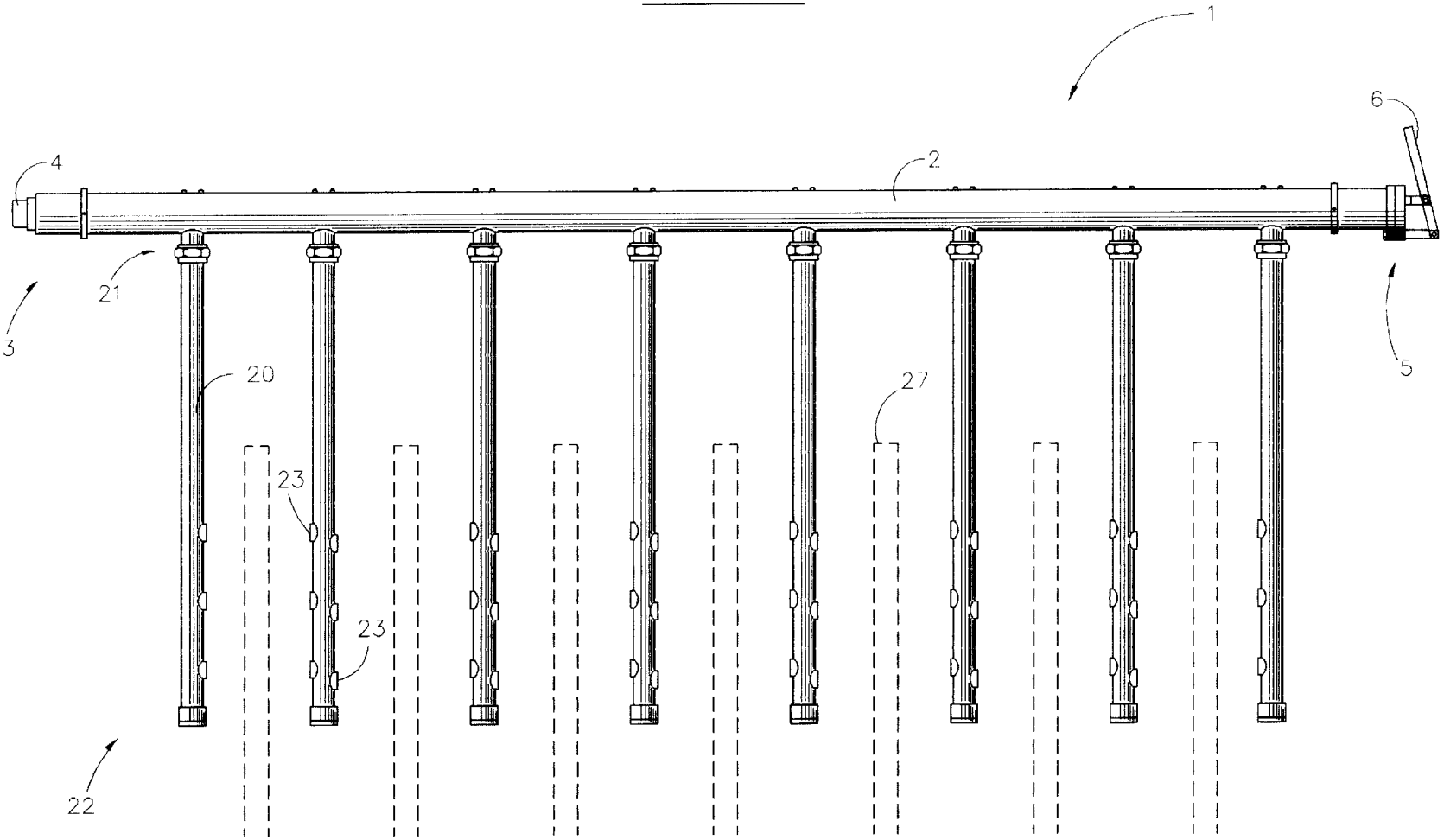
FIG. 1 is an elevational view of a self cleaning flushing shower assembly made according to this invention.
Figure 3:
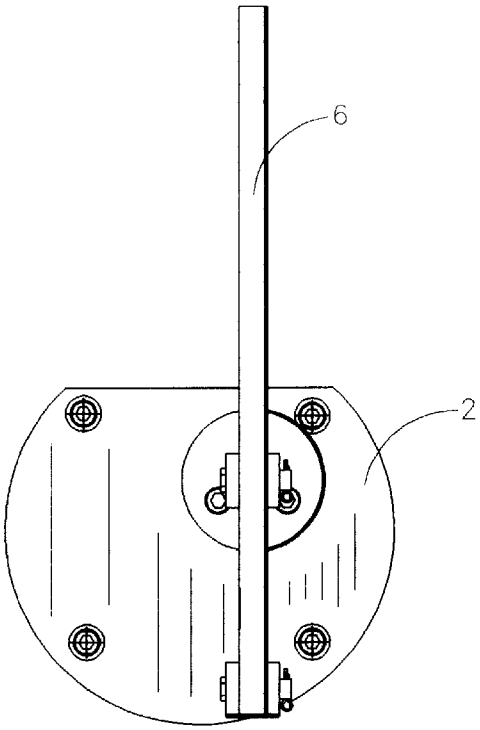
FIG. 3 is an end elevational view of FIG. 2
Figure 2:
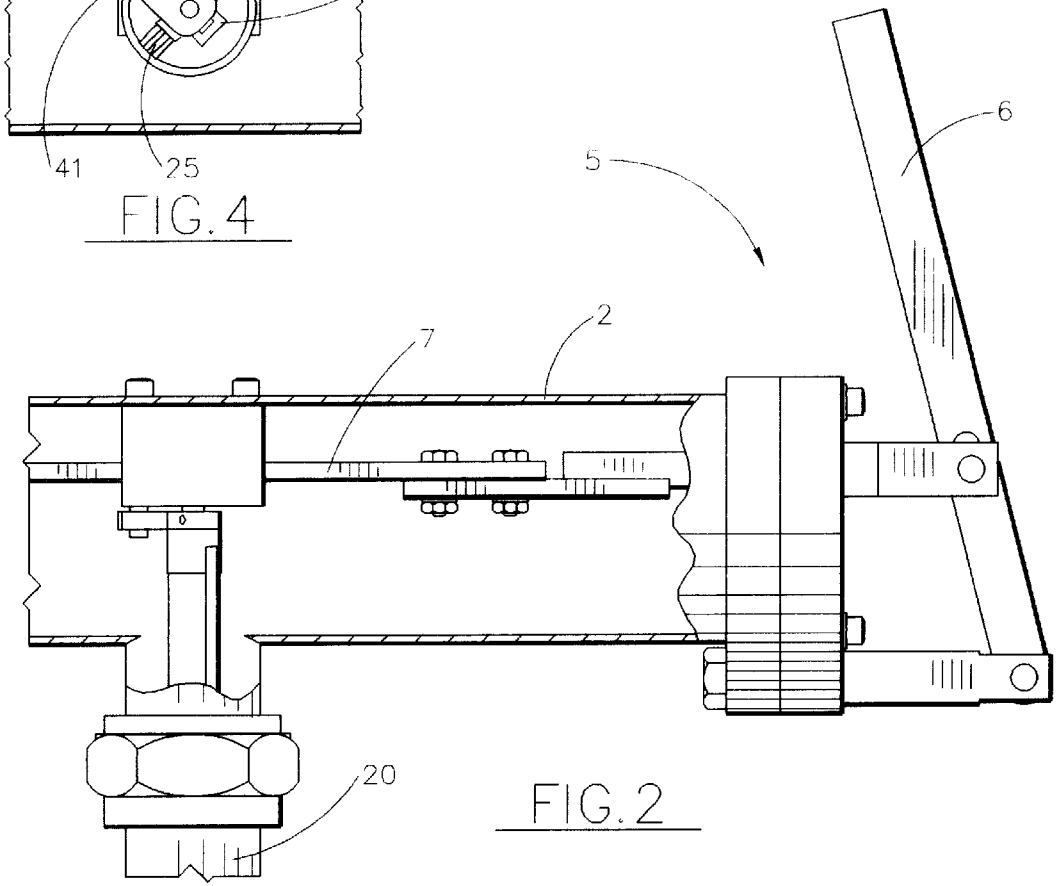
FIG. 2 is a sectioned elevational view showing a cleaner activating mechanism.

In the drawings like numbers refer to like objects.

Referring now to FIGS. 1–6, wherein a typical self cleaning flushing spray shower assembly is shown. Manifolded spray showers are typically application specific and not mass produced. Therefore, it should be understood that variations in the arrangements of the elements of the invention should be expected from application to application and the scope of this invention should not be limited to the applications disclosed.

Referring now to FIG. 1 wherein shower 1 is provided with a manifold pipe 2 having an input end 3 provided with coupling means 4 for a water input line, not shown, and an operator end 5 provided with a translating means 6 for translating a central manifold rod 7. Shower 1 is provided with a multiplicity of spray wands 20 projecting transversely thereto. Each spray wand 20 having a manifold end 21 joined to manifold pipe 2 and valve end 22, at its free end and a multiplicity of spray nozzles 23 spaced along wand 20 and directed transversely to wand 20.

Referring again to FIG. 1 wherein manifold pipe 2 is shown to have a multiplicity of spray wands 20 and each spray wand 20 is shown to have a multiplicity of spray nozzles 23. Spray wands 20 are shown to have two diametrically opposed sets of multiple spray nozzles 23 and disposed between adjacent spray rods 20 are filter discs 27. In use, filter discs 27 collect particle mats as they filter discharge water. Thereafter the mats are separated from the filter by a skiving spray. Thereafter, filter discs 27 pass between spray wands 20 where a pressure spray impinqes on both sides of filter discs 27 to dislodge residual particles to renew filter 27 to again collect a particle mat.

Figure 5:
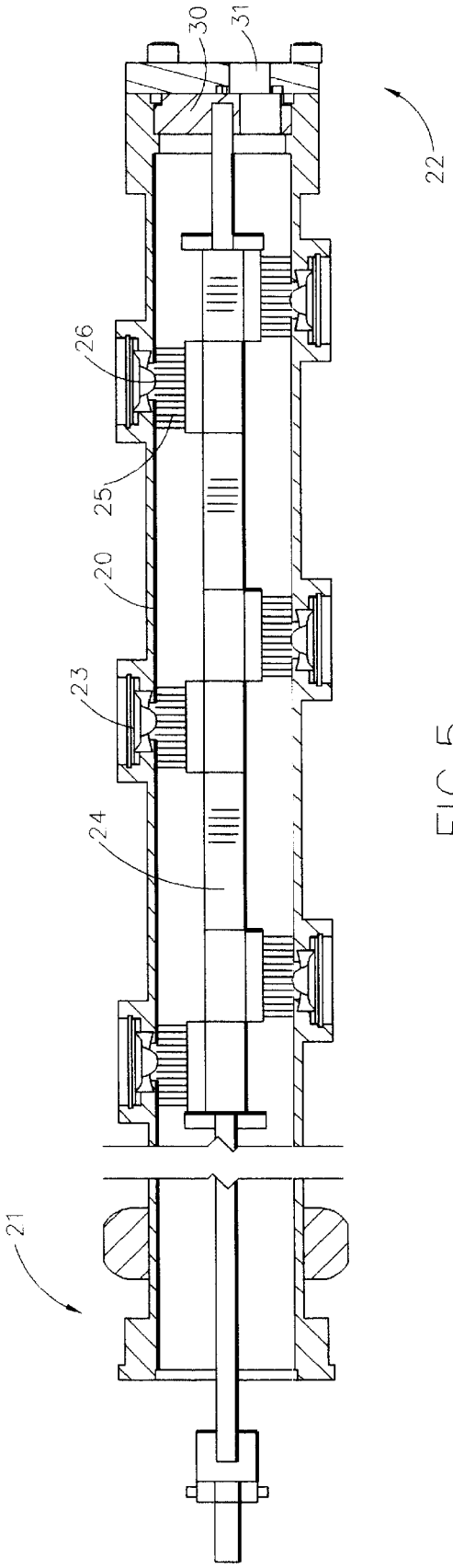
FIG. 5 is a sectioned elevational view of a spray wand of the assembly of FIG. 1.

Referring now to FIG. 5 wherein a wand 20 is shown to have a central brush and valve rotating rod 24. Brushes 25 project laterally from rod 24 and serve to wipe across spray orifices 26 of nozzles 23 when rod 24 is rotated. Wand 20 is provided at its valve end 22 with valve 30 attached to rod 24 so that valve 30 is opened and closed when rod 24 is rotated so that brushes 25 sweep across spray orifices 26. Valve 30 is provided with a discharge orifice 31 that is sized to discharge water from wand 20 at a rate that is compatible with the design parameters of shower 1 so that when the discharge valves 30 of all the wands 20 which are a part of shower 1 are opened at the same time water will continue to flow through all of the wands 20 under pressure. Where indicated, discharge orifice 31 is sized to provide a discharge rate that will facilitate negative pressure clearing of spray orifices 26.

Figure 4:
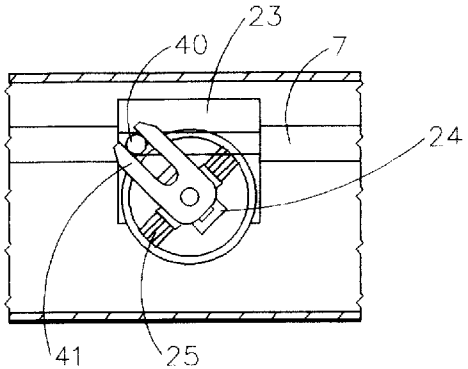
FIG. 4 is a sectioned plan view of a valve and brush rod rotating means.
Figure 6:
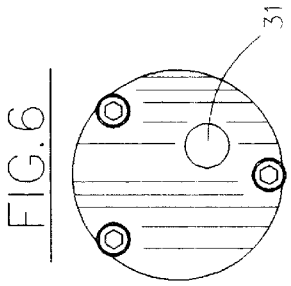
FIG. 6 is a end view of the disk valve of the wand of FIG. 5.
Figure 7:
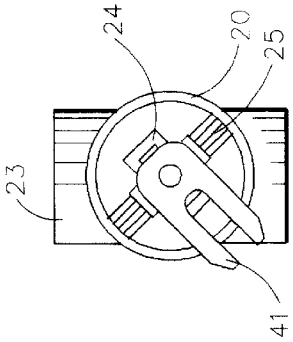
FIG. 7 is a plan view of a rod rotating means of this invention.

Referring now to FIGS. 4 and 7 wherein a rotating means for valve and brush rotating rod 24 is illustrated. When manifold rod 7 is caused to translate, pin 40 acting in clevis 41 causes brush and valve rotating rod 24 to rotate and move brushes 25 past orifices 26 of nozzles 23 and to open and close valve 30.

The above disclosures and descriptions are enabling. Because the shower of this invention is novel in its use of multiple spray wands and is typically installation specific, the invention possesses some novel and unobvious design characteristics, the disclosure of which are necessary in order to meet the "best mode" requirements for an invention disclosure.

Self cleaning spray or shower systems are useful in situations wherein materials can accumulate in and around the interior structures of spray nozzles and wherein removing the shower from service in order to clean the nozzles is disruptive. Heretofore, self cleaning spray or shower systems have been single chamber or wand systems. The cleaning of the nozzles and the flushing of the dislodged materials from the chamber involved simultaneously moving materials dislodging apparatus within the chamber so as to dislodge obstructions from the spray nozzles and opening a discharge valve to permit the flushing of the water carrying the dislodged materials out of the chamber. A cleaning and flushing cycle, typically would be completed in a few seconds without significant disruptions of related systems.

In applications wherein multiple spray wands or showers are indicated, the employment of multiple independently operating spray rods is not usually economically practical. Interconnected or manifolded spray systems suffer from problems associated with the fact that in interconnected systems, a drop in pressure in one spray wand results in a drop in pressure in the system. In order to minimize the period of pressure disruption in the manifolded system of this invention, the invention is provided with means for rotating all the cleaning brushes and opening up all the discharge valves at once.

When the manifolded system of this invention is intended to function substantially the same as single chamber systems, the best mode of practicing the invention involves designing the discharge orifice, the wand and the manifold chambers so that water will continuously flow through the wands most distal from the water pressure source.

EXAMPLE

In the embodiments shown in FIGS. 1–7 the discharge orifice 31 is 0.5 inches in diameter the spray wand 20 has a diameter of 1.5 inches and the manifold pipe 2 has a diameter of 3.0 inches. A good rule of thumb in designing systems such as the eight wand system shown is that the discharge orifice should have an area in the order of; 1/N times the cross sectional area of one of the wands, and that the manifold has a cross sectional area in the order on N/2 times the cross sectional area of the wand, where N is the number of wands joined to the manifold. The embodiment of FIGS. 1–7 has been tested and functions well with a cleaning and flushing cycle in the order of 3–5 seconds.

It has been discovered that, in some systems the materials that has accumulated to obstruct the spray nozzles is of a nature that unless it is carried away form the spray nozzles in a turbulent stream, it will tend to return to a position to obstruct a spray nozzle. It has further been discovered that in some systems the materials that have accumulated are configured so that they are keyed into the spray orifice and the cleaning tool is unable to dislodge them and a continued outward flow of water through the orifice serves to maintain these accumulations in place in the orifice.

It has been discovered that when the manifolded self cleaning flushing spray apparatus is provided with a means for shutting off the flow of water to the manifold in coordination with the opening of the discharge valves of the wands, a negative pressure is created in the spray orifices due to the venturi effect developed at the nozzles and the resulting drawing in of air into the wand chamber.

The negative pressure along with the air flow into the nozzles serves as an effective assist is clearing the nozzle orifices of obstructing materials. The counter flow of air ascending in the water being discharged and descending creates a vigorous turbulence which serves to carry away dislodged materials and keep them in a water suspension until they are discharged with the water exiting the discharge orifice.

It has further been discovered that when the manifold chamber is provided with an air vent which is opened in coordination with the opening of the discharge valves and the shutting down of the water supply a rapid transition from spray mode to negative pressure assisted nozzle cleaning is achieved and that the flushing of the wands and the refilling of the system can be accomplished in a sufficiently short interval, typically 3 to 5 seconds, so as not to be disruptive of the operating system with which the shower is associated.

Figure 8:
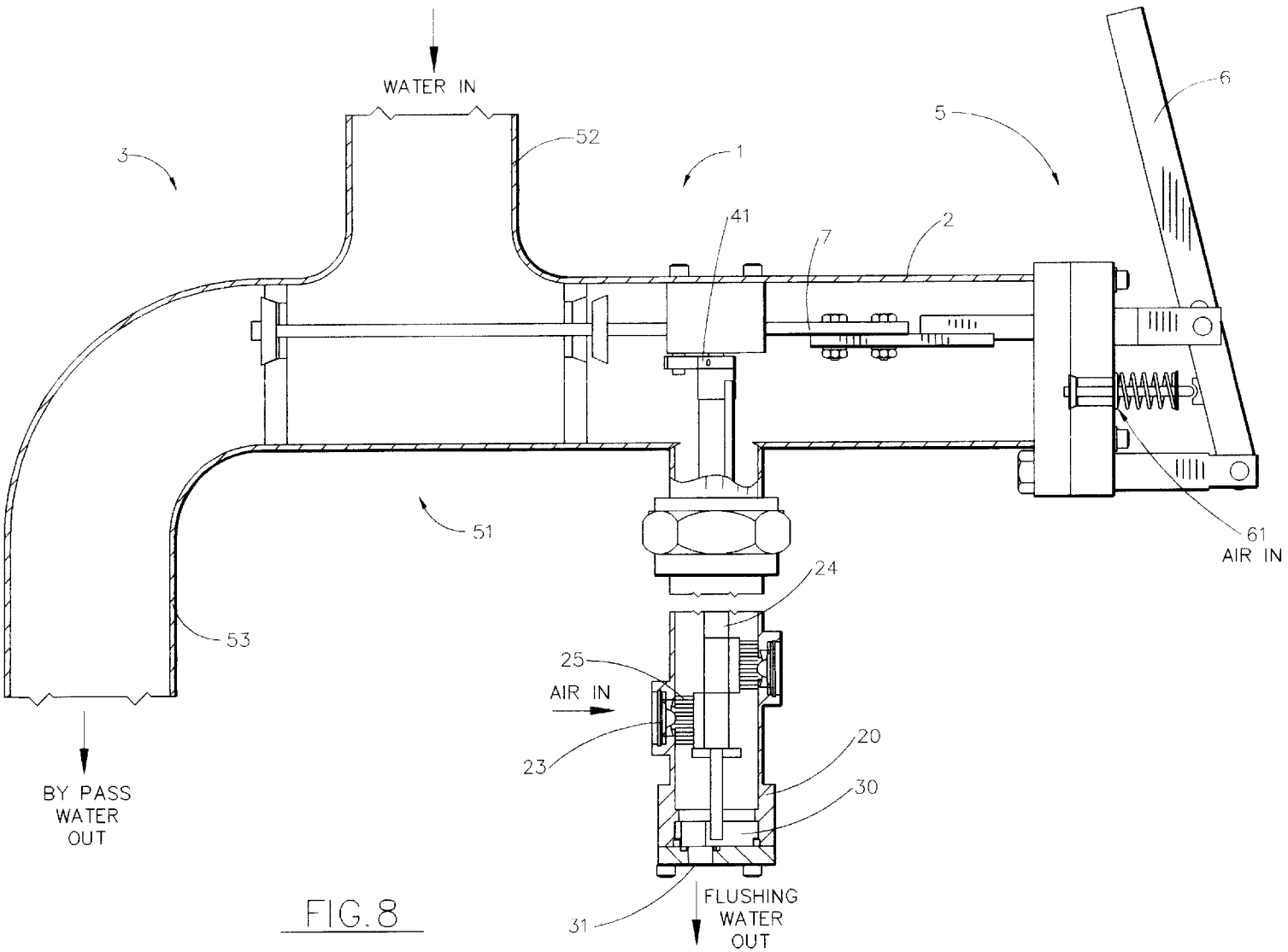
FIG. 8 is a schematic elevational view of a valve and vent arrangement of this invention.

Referring now to FIG. 8 wherein the mechanisms of FIGS. 1–7 are shown to be supplemented by valve 51 and a vent 61. Valve 51 is attached to manifold rod 7 and serves to redirect water passing through input pipe 52 from manifold 2 to bypass pipe 53. At the same time vent 61 is opened thus permitting air to enter manifold 2 so that the water in manifold 2 and wands 20 can escape rapidly. This valve and vent combination permits the rapid evacuation to the shower system followed by a reversing of the valving and venting so as to permit the system to refill and resume normal operations in the shortest obtainable times. The rapid dropping of pressure at nozzles 23 followed by a negative pressure and air flow into nozzles 23 followed by a rapid resumption of pressure and water flow through nozzles 23 can be an effective nozzle cleaning sequence.

The above disclosures would enable one skilled in the art to make and use this invention and represent the best modes of practicing the invention known to the inventors at the time of these disclosures.

Because the above disclosed inventions will ordinarily be application specific and because to disclose all the possible novel and unobvious combinations of elements to which the inventions and discoveries disclosed above may participate would cause the specification to become prolix and greatly multiply the drawings, the scope of this invention should not be limited to the embodiments disclosed, but should only be limited to all equivalents thereto which would be made obvious by the above disclosures to one skilled in the art.

What is claimed is:

1. A spray nozzle cleaning apparatus for manifolded spray wand assemblies comprising;

a) an elongate manifold chamber having a cross sectional area and a liquid introduction port and a multiplicity of shower wands extending laterally from the manifold, b) each wand having a cross sectional area, a manifold end and a valve end and at least one spray orifice directed laterally to said wand, c) a rotating valve at said valve end of each wand and the rotating valve is provided with a discharge port that has an area that is no larger than 1/N times the cross sectional area of one of the wands where N equals the number of wands extending from said manifold, d) a central brush rod secured to said valve and at least one brush secured to said rod and said brush is positioned so that said brush will pass over said spray orifice and said valve is openable and closeable by means of the rotation of said rod, e) a means for rotating all the brush rods in all the shower wands in unison.

2. The apparatus of claim 1 wherein the liquid introduction port is provided with a bypass valve as a means for directing liquids away from the liquid introduction port during a flushing and cleaning cycle.

3. The apparatus of claim 1 wherein the manifold chamber is provided with an air vent that is openable during the flushing and cleaning cycle so as to permit air to enter the manifold.

4. A spray nozzle cleaning apparatus for manifolded spray wand assemblies comprising;

a) an elongate manifold chamber having a liquid introduction port and a multiplicity of shower wands extending laterally therefrom, b) each wand having a manifold end and a valve end and two diametrically positioned rows of spray nozzels positioned to spray laterally to said wand and each row having a multiplicity of spray nozzles and the nozzles have spray orifices, c) a rotating valve at said valve end of each wand and the rotating valve is provided with a discharge port that has an area that is no larger than 1/N times the cross sectional area of one of the wands where N equals the number of wands extending from said manifold, d) a central brush rod secured to said valve and a multiplicity of brushs secured to said rod and said brushes are positioned so that said brushs will pass over said spray orifices when said valve is opened and closed by means of the rotation of said rod, e) a means for rotating all the brush rods in all the shower wands in unison.

5. The apparatus of claim 4 wherein the manifold has a cross sectional area that is in the order of N/2 times the cross sectional area of a wand where N equals the number of wands that are connected to said manifold.

* * * * *